US007008031B2

(12) United States Patent
Doerflinger et al.

(10) Patent No.: US 7,008,031 B2
(45) Date of Patent: Mar. 7, 2006

(54) METHOD FOR ATTACHING STACKABLE COMPONENTS

(75) Inventors: David A. Doerflinger, Racine, WI (US); Daniel B. Guptail, Oak Creek, WI (US)

(73) Assignee: Snap-on Incorporated, Pleasant Prairie, WI (US)

( * ) Notice: Subject to any disclaimer, the term of this patent is extended or adjusted under 35 U.S.C. 154(b) by 216 days.

(21) Appl. No.: 10/281,350

(22) Filed: Oct. 25, 2002

(65) Prior Publication Data

US 2004/0119380 A1 Jun. 24, 2004

(51) Int. Cl.
*A47B 87/00* (2006.01)

(52) U.S. Cl. ..... 312/352; 312/107; 403/353

(58) Field of Classification Search ..... 312/107, 312/108, 257.1, 111, 352, 140; 403/339, 403/341, 353, 364, 395

See application file for complete search history.

(56) References Cited

U.S. PATENT DOCUMENTS 2,040,374 A * 5/1936 Grimes
2,135,401 A * 11/1938 Kiff
2,203,716 A * 6/1940 Bergman
2,593,998 A * 4/1952 Dupuis
2,733,112 A * 1/1956 Dunham
3,287,075 A * 11/1966 Batke et al.
3,552,579 A * 1/1971 Simon et al. ..... 211/126.12
3,748,006 A * 7/1973 Levit et al. ..... 312/111
4,648,737 A * 3/1987 Lake et al. ..... 403/322.4
5,007,760 A 4/1991 Mullen et al.
5,014,482 A 5/1991 Alexander
5,508,891 A 4/1996 Rowe et al.
5,535,898 A 7/1996 Burgess, Sr. et al.
5,570,543 A 11/1996 Bishop
5,599,207 A 2/1997 Lai
5,620,059 A 4/1997 Crispeno
5,626,375 A 5/1997 Plett
5,630,644 A 5/1997 LaPointe et al.
5,720,460 A 2/1998 Watson
5,779,206 A 7/1998 Harris et al.
5,794,395 A 8/1998 Reed
5,846,018 A 12/1998 Frobosilo et al.
5,885,024 A 3/1999 Zupan et al.
5,897,086 A 4/1999 Condon
6,000,668 A 12/1999 Mannick
6,036,149 A 3/2000 Del Pino et al.
6,047,515 A 4/2000 Behlen
6,065,724 A 5/2000 Arslan et al.
6,131,361 A 10/2000 Murphy
6,250,041 B1 6/2001 Seccombe

FOREIGN PATENT DOCUMENTS

CH 602049 * 7/1978

* cited by examiner

*Primary Examiner*—James O. Hansen
(74) *Attorney, Agent, or Firm*—Seyfarth Shaw LLP

(57) ABSTRACT

An improved method and apparatus of attaching upper and lower component members of a tool storage assembly. The method and apparatus comprises at least one aperture located on a top ceiling portion of the lower component member, an L-shaped attachment bracket with its short leg penetrating the apertures in the ceiling portion, a supporting means on the bottom of the upper component member, and a fastening means for securing a long leg of the L-shaped attachment bracket to the supporting means.

11 Claims, 4 Drawing Sheets

METHOD FOR ATTACHING STACKABLE COMPONENTS

BACKGROUND

The present patent application relates generally to attachment devices for stackable upper and lower component members and, more particularly, to a method and apparatus of attaching a component top tool chest to a bottom tool cabinet.

An assembled tool storage assembly with sliding drawers or opening doors may be constructed of stackable component members. For example, a tool chest with sliding drawers may be placed on top of a tool cabinet, such as a roll cabinet, with casters to form a storage assembly which allows for easy mobility and enhanced storage capacity. As such, based upon this design of stackable component members, an assembled tool storage assembly is quite flexible in that it is customizable by combining different storage units.

To ensure that such an assembly is safe and secure, there needs to be a reliable method of securing the stacked components. Typically this consists of placing a tool chest on top of a tool cabinet, such as a roll cabinet, temporarily removing the sliding drawers of the tool chest, removing any drawers of the tool cabinet, removing any other obstacles, and placing bolts through multiple bolt holes located in the top surface of the tool cabinet which correspond with threaded welds or press nuts in the bottom surface of the tool chest. Each bolt is secured conventionally into the threaded weld or press nuts. As such, the tool cabinet must not only have at least one drawer removed, which can sometimes be quite heavy due to its contents, but the tool chest must also be precisely placed on top of the tool cabinet to ensure that the respective threaded weld or press nuts of the tool chest and the bolt holes of the tool cabinet are properly aligned.

This alignment is generally accomplished with a trial and error process of attempting to place the bolts through the bolt holes combined with manually feeling the threaded weld or press nut locations due to the fact that a visual inspection of the bolt hole areas is difficult due to the locations of the bolt holes and construction configuration of the tool chest and tool cabinet. Furthermore, securing a bolt into a threaded weld or press nut is often difficult because, once the chest is in place, the threaded weld or press nuts may not be readily visible. As can be imagined, this process of securing the component members together can be quite time consuming and frustrating. As a result, the two component members are often not secured or only partially secured.

SUMMARY

In order to overcome the limitations and disadvantages of the prior art, the present application provides an improved method and apparatus of securing and attaching an assembly of stackable upper and lower component members, such as tool storage components. Such an assembly may have at least one lower member, such as the tool cabinet, and one upper member, such as a tool chest.

In an embodiment, at least one aperture is located in a ceiling portion of the tool cabinet. In an embodiment, at least one aperture is located in each of the four corners of the ceiling of the tool cabinet.

An attachment bracket with a first leg extending at approximately 90 degrees from a second leg is configured wherein its first leg is of such dimensions and configuration as to easily fit into the apertures of the ceiling portion. In an embodiment, the second leg of the attachment bracket is configured and dimensioned to not fit into the apertures. As such, it is impossible for the entire attachment bracket to penetrate the apertures due to the configuration of the second leg.

In an embodiment, the second leg of the attachment bracket also has a protruding member. In an embodiment, the protruding member is a flanged extension that protrudes in an angular configuration from the plane of the second leg. As such, when the second leg is placed on a flat surface, the flanged extension prevents the bracket from lying completely flat against the surface and thus facilitates easy grasping or prying of the distal leading edge of the bracket with a hand or appropriate tool. In an embodiment, the second leg of the attachment bracket also has an aperture located approximately in the center of the second leg.

In an embodiment, a supporting means is attached to the bottom of the tool chest. In an embodiment, the supporting means consists of at least two rails that are parallel to the front of the tool chest. Each rail is located and configured so that when the tool chest is placed on top of the tool cabinet, the rails support the weight of the tool chest and the apertures in the top ceiling of the tool cabinet are accessible immediately adjacent of the outside faces of the rails. In another embodiment, the supporting means is at least two rails running parallel to the sides of the tool chest. In yet another embodiment, the supporting means is footing protrusions extending downwardly from the bottom of the tool chest and are configured so that when the tool chest is placed on top of the tool cabinet, the footing protrusions support the weight of the tool chest and the apertures in the top ceiling of the tool cabinet are accessible immediately adjacent of the intersection of the footing protrusions and the top ceiling.

In an embodiment, at least one attachment bracket is utilized and each aperture located on the ceiling of the tool cabinet is penetrated with the first leg of an attachment bracket. The attachment brackets are positioned so their second legs are facing outwardly and are lying as flatly as possible against the ceiling of the tool cabinet but are prevented from lying completely flat due to their protruding members. The tool chest is then lowered and positioned on top of the tool cabinet ceiling so the attachment brackets are not obstructed by the tool chest or the supporting means. Each attachment bracket is then pivotally rotated in a 90-degree manner so the second leg of each attachment bracket is disposed alongside the exterior surface of the tool chest of the respective supporting means. In an embodiment, a fastening means is used to attach each attachment bracket to the outside face of the supporting means to secure the attachment bracket.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages, should be readily understood and appreciated.

DETAILED DESCRIPTION

Figure 1:
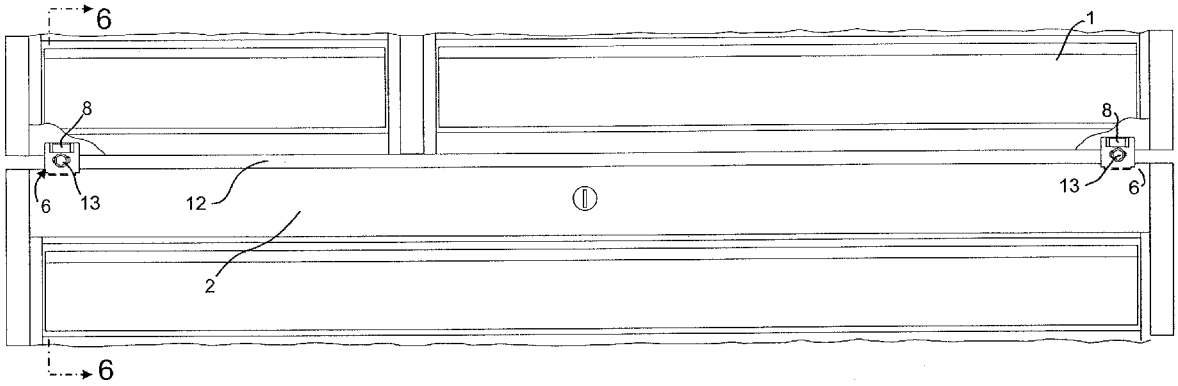
FIG. 1 is a fragmentary front elevation view of an embodiment in an assembled condition.
Figure 6:
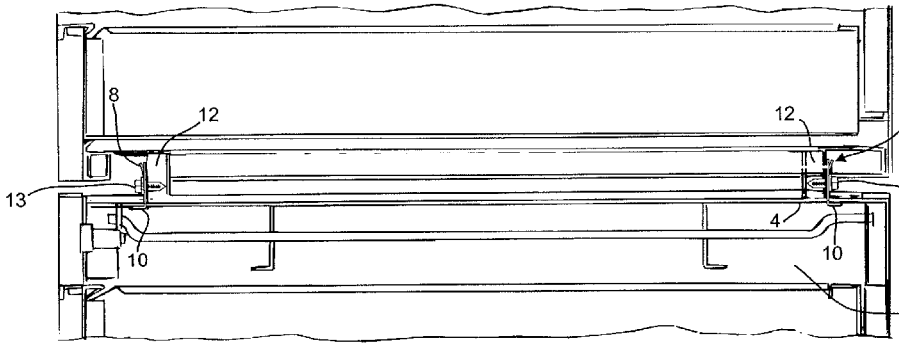
FIG. 6 is a cross-sectional view taken along line A—A of FIG. 1.

Referring to FIG. 1, there is illustrated an improved method and apparatus for securing and attaching together at least two members of stackable component equipment, such as a tool storage assembly, having an upper member and a lower member. The upper member has a bottom and the lower member has a ceiling. In an embodiment, the upper member is a tool chest 1 and is attached to a tool cabinet 2 lower member with an attachment bracket 6 fixedly attached to either the exterior surface of the tool chest 1 or a supporting means 12 thereon.

Figure 2:
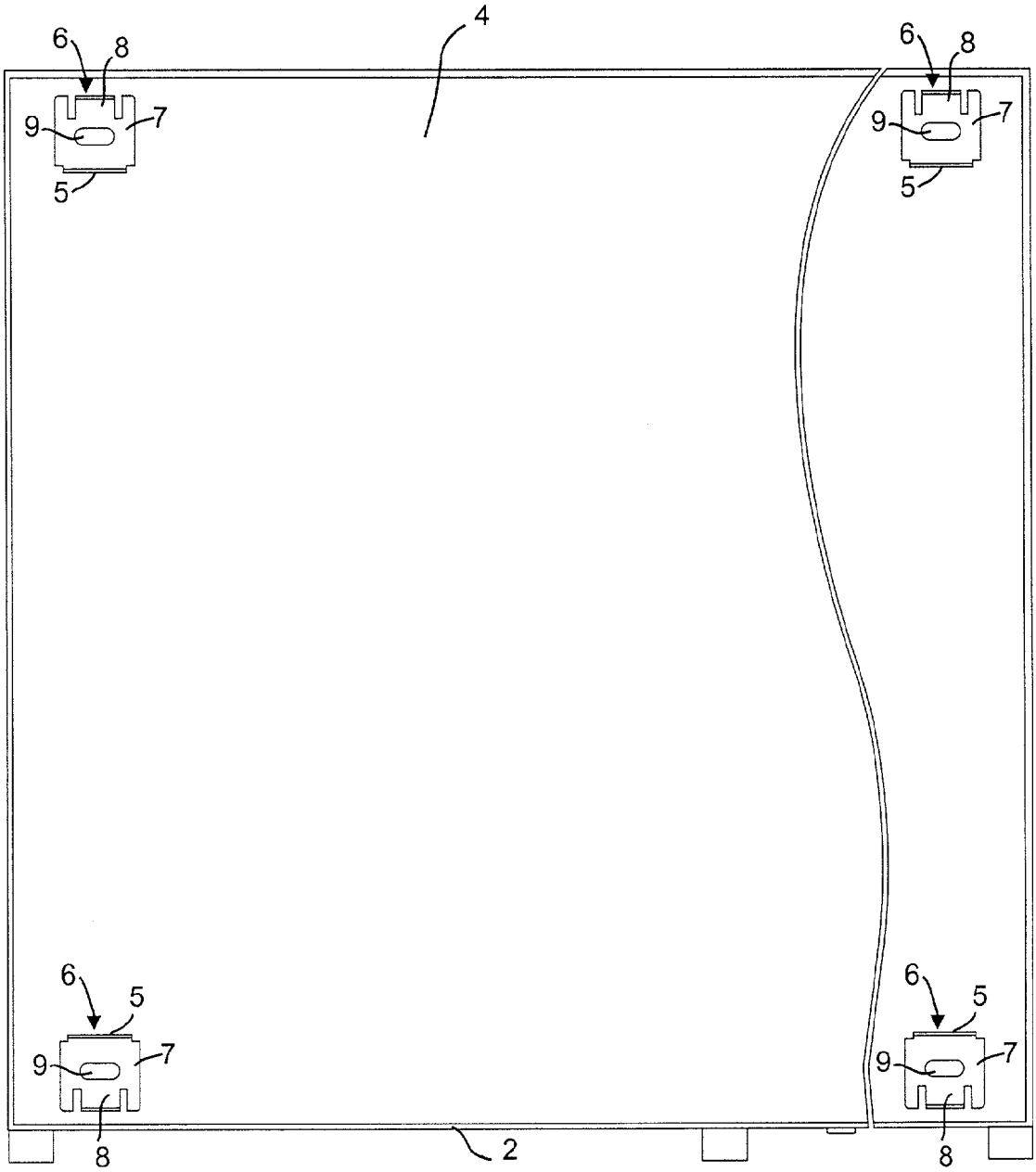
FIG. 2 is a top plan view of the top ceiling of a tool cabinet, with portions broken away.

Referring to FIG. 2, a ceiling 4 of a typical tool cabinet 2 is shown. In an embodiment, at least one ceiling aperture 5 is placed in the ceiling 4. In an embodiment, each ceiling aperture 5 has an oblong geometric configuration. In an embodiment, at least one ceiling aperture 5 is located at each corner of the ceiling 4.

Figure 3:
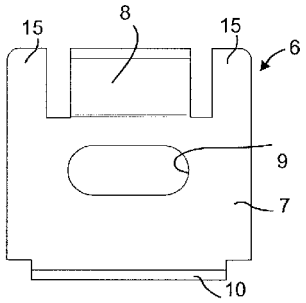
FIG. 3 is an enlarged elevation view an L-shaped bracket of the embodiment of FIG. 1.
Figure 4:
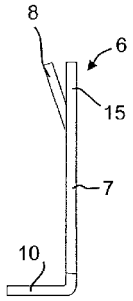
FIG. 4 is a side view of the L-shaped bracket of FIG. 3.
Figure 5:
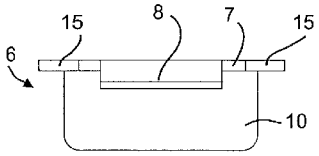
FIG. 5 is a top view of the L-shaped bracket of FIG. 3.

Referring to FIGS. 3–5, an improved attachment bracket 6 is shown. In an embodiment, the attachment bracket 6 has a first leg 10 extending from a second leg 7 at a predetermined angle, which may be substantially 90 degrees. The first leg 10 is of a geometric configuration and dimensions to easily extend through the ceiling aperture 5 (FIG. 2). In an embodiment, the second leg 7 is of a geometric configuration and dimensions such as to be incapable of extending through the ceiling aperture 5 (FIG. 2). In such an embodiment, it is impossible for the entire attachment bracket 6 to penetrate completely through the ceiling aperture 5 (FIG. 2).

In an embodiment, the attachment bracket 6 is an L-shaped bracket with a first leg 10 shorter than the second leg 7.

In an embodiment, the second leg 7 has an aperture 9. In an embodiment, the aperture 9 is located in the approximate center of the second leg 7. In an embodiment, the aperture 9 has an oblong or oval geometric configuration.

In an embodiment, the second leg 7 has a protruding member 8 located at its distal end and extending inwardly towards the first leg 10. In such an embodiment, when the second leg 10 is placed on a flat surface, the protruding member 8 prevents the second leg 10 from lying completely flat against the surface, but rather enables the leading edge 15 of the second leg 7 to be easily lifted with a finger or suitable tool. In an embodiment, the protruding member 8 is an angular protruding flange extending from the second leg 7 plane inwardly generally towards the first leg 10.

Referring to FIGS. 1, 2, 6 and 8, the bottom of the tool chest 1 may include a supporting means 12. In an embodiment, the supporting means 12 includes at least one support rail located toward the front of the tool chest 1 and at least one support rail located toward the back of the tool chest 1, each placed parallel to the front of the tool chest 1. Each such support rail is located and configured so that when the tool chest 1 is disposed in its mounting position on top of the ceiling 4 of the tool cabinet 2, the support rails support the weight of the tool chest 1, and any of the contents within the tool chest 1, and each aperture 5 in the ceiling 4 is accessible immediately adjacent the outside or exterior surfaces of the rails.

In another embodiment, the supporting means 12 is at least one support rail located on each side of the tool chest 1, each running parallel to the sides of the tool chest 1. In such an embodiment, each end of each support rail has a solid exterior surface face. Each support rail is further of such a length and placement that when the tool chest 1 is placed in its mounting position on the ceiling 4 of the tool cabinet 2, the support rails support the weight of the tool chest 1 and its contents, and each aperture 5 in the ceiling 4 is accessible immediately adjacent the solid face of the rail ends.

In yet another embodiment, the supporting means 12 is a plurality of footing protrusions extending downwardly from the bottom of the tool chest 1 and is configured and placed so that when the tool chest 1 is placed in its mounting position on top of the ceiling 4, the footing protrusions support the weight of the tool chest 1, and its contents, and each aperture 5 is accessible immediately adjacent the outside intersection of the footing protrusions and the ceiling 4.

Referring to FIGS. 1–8, in an embodiment, each ceiling aperture 5 has the first leg 10 of one attachment bracket 6 extending through the ceiling aperture 5. The attachment brackets 6 are disposed so that each respective second leg 7 faces in an outward direction. In an embodiment, the second legs 7 of the attachment brackets 6 located in the back of the ceiling 4 face rearward and the second legs 7 of the attachment brackets 6 located in the front of the ceiling 4 face frontward, as depicted in FIG. 2. Each second leg 7 lies as flatly as possible against the ceiling 4 but is angled in an upward direction because of the protruding member 8. Each second leg 7 is of such a length that, when disposed in an outward facing direction, the tool chest 1 or supporting means 21 cannot be located between the distal edge of the second leg 7 and any lip around the periphery of the tool cabinet 2 when the tool chest 1 is lowered into its mounting position.

The tool chest 1 is then lowered and positioned into its mounting position on the ceiling 4 so that each attachment bracket 6 is not obstructed by the tool chest 1 or the supporting means 12. In an embodiment, each second leg 7 is then pivotally rotated and disposed alongside an exterior surface of the tool chest 1. In an embodiment, each second leg 7 is pivotally rotated and disposed alongside the exterior surface of the respective supporting means 12. In an embodiment, each attachment bracket is fixedly attached to the exterior surface of the tool chest 1 or respective supporting means 12.

In an embodiment, the first leg 10 of the attachment bracket 6 is placed through the ceiling apertures 5 after placement of the tool chest 1 in its mounting position, whereupon the attachment bracket 6 is rotated and disposed alongside the exterior surface of the respective supporting means 12.

Figure 7A:
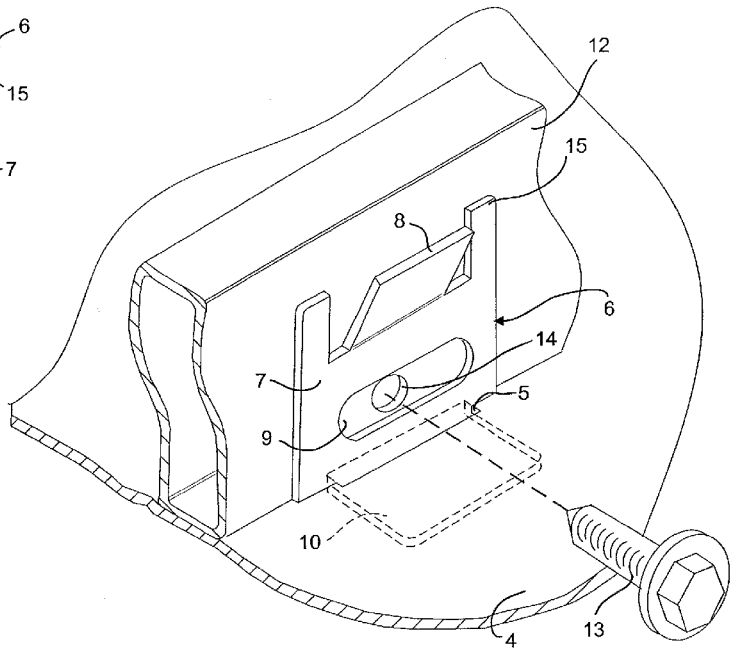
FIG. 7*a* is an enlarged, fragmentary perspective view depicting the operation and assembly of an embodiment of the attachment device of the present invention.
Figure 7:
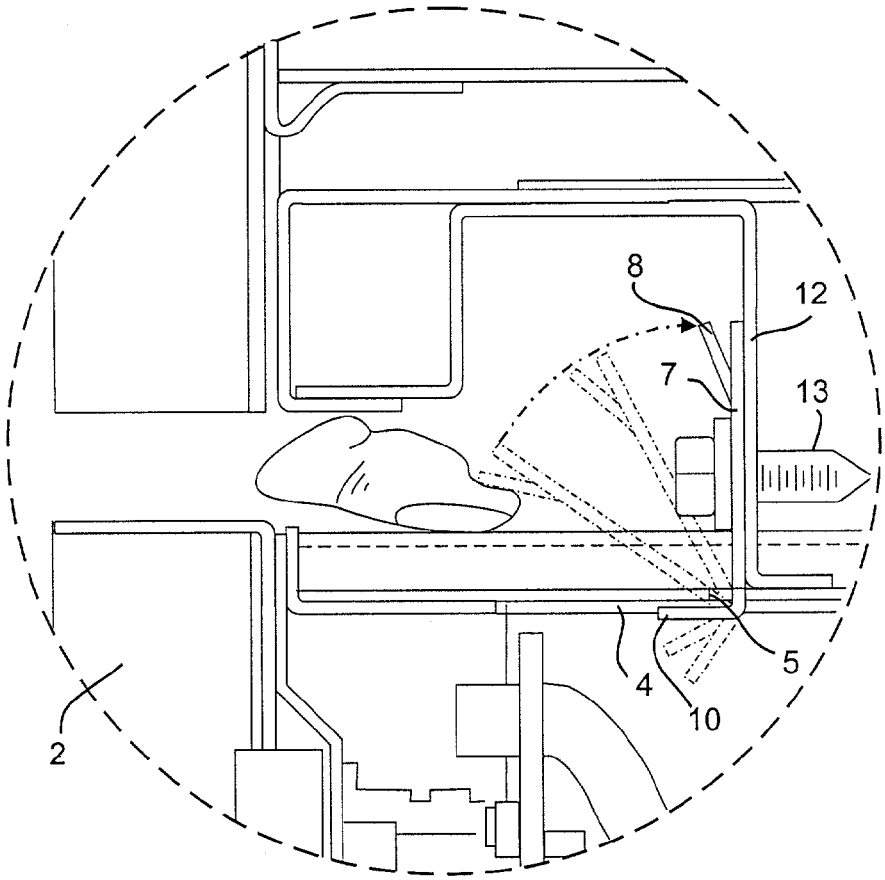
FIG. 7 is an enlarged, fragmentary side view depicting the operation and assembly of an embodiment of the attachment device of the present application.
Figure 8:
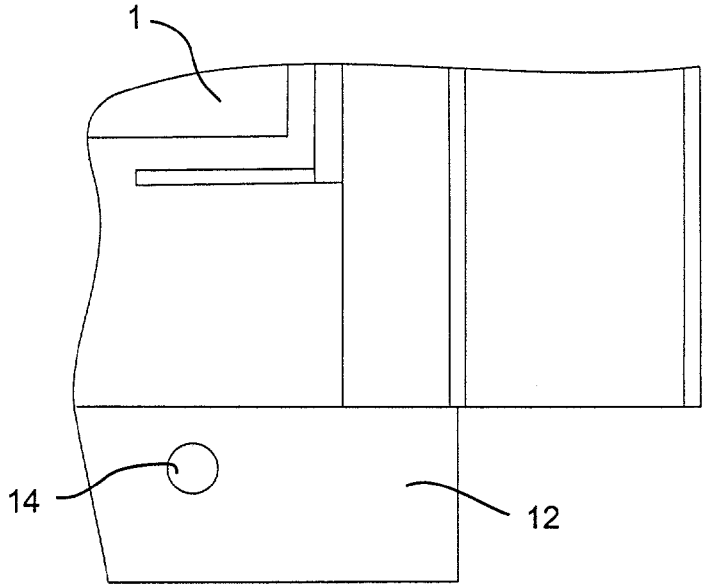
FIG. 8 is an enlarged, fragmentary elevation view depicting an embodiment with supporting means and attachment aperture location.

In an embodiment, the fastening means 13 is a threaded self-tapping screw which is attached to the exterior surface of the tool chest 1, or the supporting means 12, through the aperture 9 located in the second leg 7. In another embodiment, the fastening means 13 includes a receiving aperture 14 (see FIG. 7*a*) which is aligned with the aperture 9 in the second leg 7 and located in the exterior surface of the upper member 1, or in the supporting means 12, and is of such a geometric configuration and diameter to receive the fastening means 13 through aperture 9. In yet another embodiment, the fastening means 13 is a threaded screw engageable with a nut, which may be non-rotatably secured on the tool chest 1 or the supporting means 12 adjacent to the receiving aperture 14.

It is to be understood, of course, that while the foregoing description and accompanying drawings is directed to an attachment method and apparatus for securing stackable component tool cabinet members, its scope and purpose should not be limited as such because the embodiments of the present application can be utilized in many different applications and environments while not diverting from the true scope and spirit of the present application. As such, the foregoing description of the present application's usability relating to stackable component members of a tool cabinet should be deemed an example of the present application's applicability rather than a limitation thereof.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

We claim:

1. A method of attaching stackable components including an upper member and a lower member, the lower member having a ceiling, the upper member having a bottom and an exterior surface, the method comprising:

providing at least one ceiling aperture in the ceiling, the ceiling aperture having a geometric configuration;

providing a supporting means on the bottom of the upper member, the supporting means having the exterior surface thereon so as to be disposable immediately adjacent the at least one ceiling aperture when the upper member is placed on the ceiling in a mounting position, wherein the supporting means comprises at least one rail located toward a front of the upper member and at least one rail located toward a back of the upper member, with each of the rails running parallel to the front of the upper member;

providing at least one attachment bracket the attachment bracket having a first leg and a second leg extending at a predetermined angle from the first leg and having a geometric configuration and dimensions to extend through the ceiling aperture;

disposing the at least one attachment bracket in a first position with the first leg extending through the ceiling aperture and with the second leg of the attachment bracket facing outwardly and lying on top of the ceiling;

placing the upper member in a mounting position on the ceiling of the lower member;

pivoting the attachment bracket to a second position with the second leg disposed alongside the exterior surface of the upper member; and attaching the second leg to the exterior surface.

2. The method of claim 1, wherein the predetermined angle is approximately 90 degrees.

3. The method of claim 1, wherein the ceiling aperture has an oblong geometric configuration.

4. The method of claim 1, wherein the second leg has a geometric configuration and dimensions to prevent penetration of the ceiling aperture.

5. The method of claim 1, wherein the second leg comprises an aperture.

6. The method of claim 5, wherein the aperture of the second leg is located in the approximate center of the second leg.

7. The method of claim 6, wherein the exterior surface of the upper member comprises a receiving aperture aligned with the aperture on the second leg.

8. The method of claim 5, wherein the aperture of the second leg comprises an oblong geometric configuration.

9. The method of claim 1, wherein the second leg comprises a protruding member.

10. The method of claim 9, wherein the protruding member comprises an angular protruding flange extending inwardly from the second leg towards the first leg.

11. The method of claim 1, wherein the first leg is shorter than the second leg.

* * * * *